US005119513A

United States Patent [19]

McKay

[11] Patent Number: 5,119,513

[45] Date of Patent: Jun. 9, 1992

[54] SPORTS BAND

[76] Inventor: William D. McKay, P.O. Box 1146, Flint, Mich. 48501-1146

[21] Appl. No.: 712,141

[22] Filed: Jun. 5, 1991

[51] Int. Cl.[5] ..... A42C 5/02

[52] U.S. Cl. ..... 2/181; 2/170; 2/DIG. 11

[58] Field of Search ..... 2/170, DIG. 11, 181, 2/171, 209.1, 425

[56] References Cited

U.S. PATENT DOCUMENTS

| | | | |
|---|---|---|---|
| 4,468,817 | 9/1984 | Nunnery | 2/DIG. 11 |
| 4,484,363 | 11/1984 | Varanese | 2/181 |
| 4,521,922 | 6/1985 | Mitchell | 2/DIG. 11 |
| 4,742,581 | 5/1988 | Rosenthal | 2/170 |
| 4,776,042 | 10/1988 | Hanson | 2/DIG. 11 |
| 4,896,378 | 1/1990 | Campana | 2/170 |
| 4,947,488 | 8/1990 | Ashinoff | 2/DIG. 11 |
| 5,054,122 | 10/1991 | Sher | 2/171 |

*Primary Examiner*—Werner H. Schroeder
*Assistant Examiner*—Diana L. Biefeld
*Attorney, Agent, or Firm*—Stetina and Brunda

[57] ABSTRACT

A sports band for absorbing perspiration and for cooling the wearer is comprised of a band of elastic absorbent material, generally toroidal in shape and is configured to be worn upon a person's head or wrist. The sports band has a slit formed upon its inner surface such that a flexible cold pack may be received thereby and disposed within the band.

4 Claims, 1 Drawing Sheet

Fig. 1
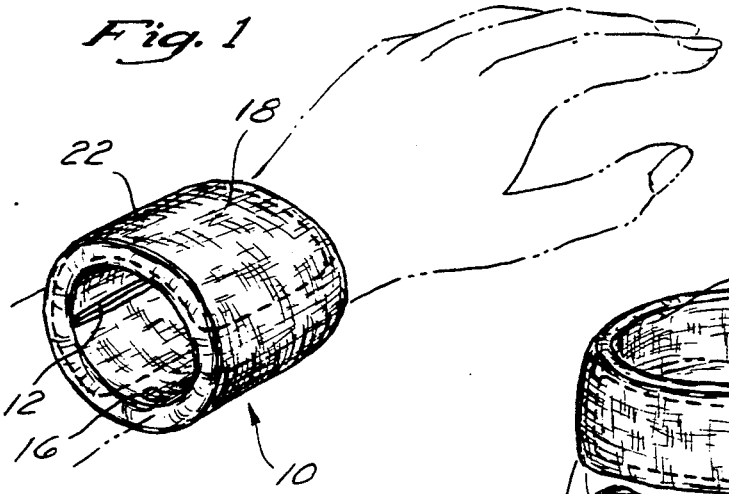
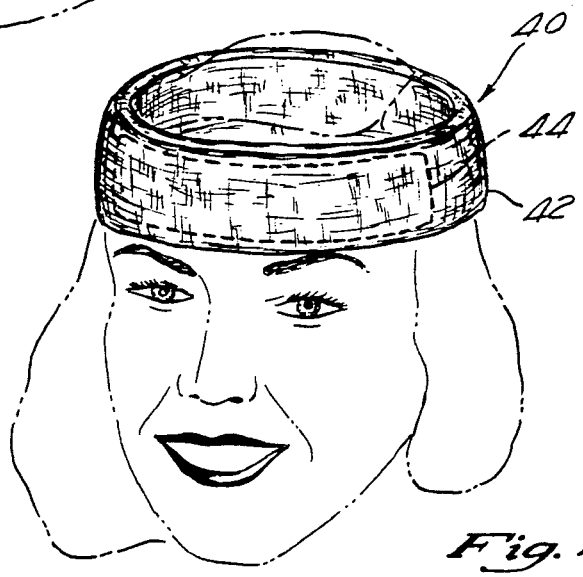
Fig. 4
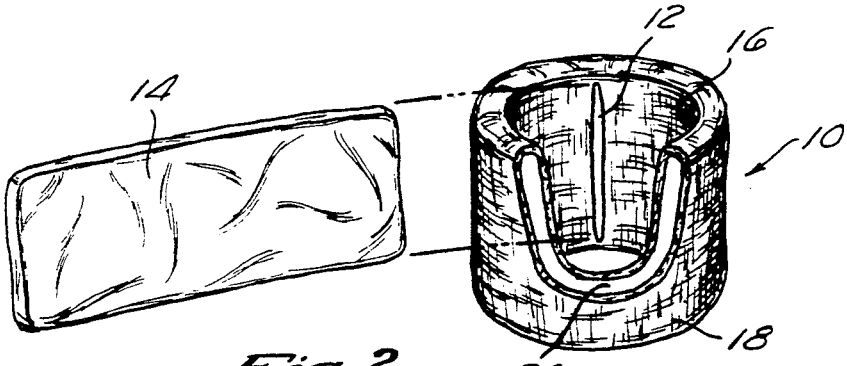
Fig. 2
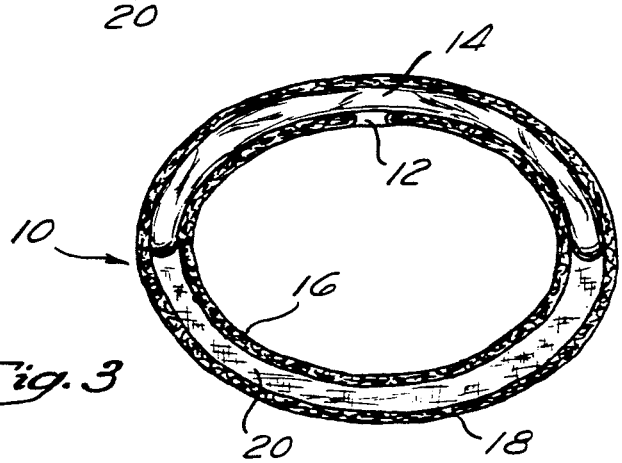
Fig. 3

SPORTS BAND

FIELD OF THE INVENTION

The present invention relates generally to sports apparel and more particularly to a sports band for absorbing perspiration and for cooling the wearer. The sports band is comprised of a band of elastic absorbent material, generally toroidal in shape and configured to be worn upon a person's head or wrist. It has a slit formed upon its inner or outer surface such that a flexible cold pack may be received thereby and disposed within the band.

BACKGROUND OF THE INVENTION

Head bands and wrist bands worn during sports, such as tennis and volleyball, are well known. Such bands are commonly worn to absorb perspiration, thereby preventing perspiration from contacting the user's eyes and/or hands where it may potentially interfere with the user's performance. Such contemporary bands typically comprise elastic terry cloth or the like which is configured to snugly encircle the wearer's wrist or the upper portion of the user's head.

Flexible cold packs for use in therapeutic applications, such as to reduce swelling and inflammation to sprained joints, are likewise well known. Such cold packs typically comprise a freezable gel disposed within a liquid-impenetrable bag which may be cooled to a temperature below the freezing point of water without becoming rigid. Such cold packs typically have a comparatively high heat capacity such that they may be placed in contact with an anatomical portion of the user's body for a prolonged period of time, i.e. 15–45 minutes, before the cooling effect is lost. Overheating of the participants during sporting events is common, particularly on hot and/or humid days. Participants frequently attempt to cool themselves by applying a water spray to their bodies such that evaporative cooling will occur. However, this technique is not particularly effective when the humidity is high. Other techniques, such as drinking cold liquids, may affect the user's performance and possibly present health risks.

No means of providing a cooled band for use in sports is presently known. Additionally, no means is presently known for maintaining contact of a therapeutic cold pack with an anatomical portion of a user's body during sports activities.

As such, although the prior art has recognized to a limited extent the problems of absorbing perspiration during sporting events and of cooling the participants, the proposed solutions have to date been ineffective in providing a satisfactory remedy. Thus, it would be desirable to provide a sports band which would both absorb the user's perspiration and provide cooling to the user.

SUMMARY OF THE INVENTION

The present invention specifically addresses and alleviates the above-mentioned deficiencies associated in the prior art. More particularly, the present invention comprises a sports band for absorbing perspiration and for cooling the wearer. The sports band is comprised of a band of elastic absorbent material, generally hollow and toroidal in shape and configured to be worn upon a person's head or wrist. It has a slit formed upon its inner surface such that a flexible cold pack may be received thereby and disposed within the band.

Thus, a user may wear the sports band of the present invention which improves performance by both absorbing perspiration which might otherwise interfere with the user's performance and by cooling the user, thereby improving the user's comfort and ability to perform.

These, as well as other advantages of the present invention, will be more apparent from the following description and drawings. It is understood that changes in the specific structure shown and described may be made within the scope of the claim without departing from the spirit of the invention.

BRIEF DESCRIPTION OF THE DRAWINGS

FIG. 1 is a perspective view of a first embodiment of a sports band according to the present invention configured to be worn upon a user's wrist;

FIG. 2 is a perspective view of a cold pack as it is about to be inserted into the sports band of FIG. 1;

FIG. 3 is a cross-sectional view of a sports band showing a cold pack disposed therein; and FIG. 4 is a perspective view of a second embodiment of a sports band according to the present invention configured to be worn upon a user's head.

DETAILED DESCRIPTION OF THE PREFERRED EMBODIMENT

The detailed description set forth below in connection with the appended drawings is intended as a description of the presently preferred embodiments of the invention, and is not intended to represent the only forms in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The sports band of the present invention as illustrated in FIGS. 1–4 which depict two presently preferred embodiments of the invention. Referring now to FIGS. 1–3, a first embodiment is comprised generally of a band 22 of an elastic absorbent material, preferably stretch terry cloth, i.e. terry cloth having elastic fibers formed therein. An opening or slit 12, preferably formed upon the inner wall 16 provides access to the void or pocket 20 (as shown in FIG. 3) formed between the inner 16 and outer 18 walls thereof. The band 22 is configured to fit snugly upon the user's wrist such that perspiration forming upon the user's forearm will be absorbed thereby rather than travel down to the user's hand where it might affect performance.

A cold pack 14 (best shown in FIG. 2) is configured to be received through slot 12 and into the pocket 20 where it may be used to cool the wearer. Those skilled in the art will recognize that various cold packs are available and suitable for use in the practice of the present invention. Such cold packs typically comprise a gel which remains flexible after being cooled to below the freezing point of water. The gel is contained within a plastic or other bag. Such cold packs are commonly used to liquid-impenetrably administer therapy to injured or sprained joints, and in the treatment of arthritis and bruised muscles.

The cold pack 14 is disposed between the inner 16 and outer 18 walls of the band 22. The walls 16 and 18 insulate the cold pack 14 from the user and the external environment to help maintain the cool temperature thereof. The inner wall 16 provides a degree of insulation between the user and the cold pack 14 such that heat transfer is thereby regulated and the user therefore does not perceive the cold pack 14 as being excessively cold.

Referring now to FIG. 4, a second embodiment of the sports band of the present invention is illustrated. The band 42 is configured to fit upon the upper portion of a user's head such that it crosses the forehead. The cold pack 44, contained therein in the manner of the first embodiment, is preferably positioned across the forehead of the user.

The bands 22 and 42 of the first and second embodiments, respectively, are preferably comprised of a terry cloth or terry cloth-like material having elastic properties along at least the longitudinal axis thereof such that the band may be stretched sufficiently to be worn snugly upon the wrist or head. Those skilled in the art will recognize that various materials and/or combinations of materials are likewise suitable.

It is understood that the exemplary sports bands described herein and shown in the drawings represent only presently preferred embodiments of the invention. Indeed, various modifications and additions may be made to such embodiments without departing from the spirit and scope of the invention. For example, the sports band need not be limited to the simple toroid shape described and illustrated, but rather may be of any shape suitable for covering a substantial portion of the user's anatomy. Indeed, the sports band of the present invention need not be limited to use wherein it is worn upon the user's wrist and/or head. Rather, those skilled in the art will recognize that various portions of the anatomy may be suitable for such use. Thus, these and other modifications and additions ma be obvious to those skilled in the art and may be implemented to adapt the present invention for use in a variety of different applications.

What is claimed is:

1. A sports band for absorbing perspiration and for cooling the wearer, said sports band comprising:

(a) a band of elastic absorbent material formed into a continuous loop and having a substantially enclosed void formed therein, said band configured to be worn by a person;

(b) a flexible cold pack disposed within said void and;

(c) a slit formed along the inner surface of said band coextensive with said void and sized to receive said cold pack.

2. The Sports Band as recited in claim 1, wherein said band is comprised of stretch Terry cloth.

3. The Sports Band as recited in claim 1, wherein said band is configured to be worn about a person's head.

4. The Sports Band as recited in claim 1, wherein said band is configured to be worn about a person's wrist.

* * * * *